US011229329B2

(12) United States Patent
Elliott

(10) Patent No.: US 11,229,329 B2
(45) Date of Patent: Jan. 25, 2022

(54) DOUBLE RING SHOWER LINER

(71) Applicant: Kenney Manufacturing Company, Warwick, RI (US)

(72) Inventor: Timothy Elliott, Attleboro, MA (US)

(73) Assignee: Kenney Manufacturing Company, Warwick, RI (US)

( * ) Notice: Subject to any disclaimer, the term of this patent is extended or adjusted under 35 U.S.C. 154(b) by 0 days.

(21) Appl. No.: 17/086,745

(22) Filed: Nov. 2, 2020

(65) Prior Publication Data

US 2021/0259480 A1 Aug. 26, 2021

Related U.S. Application Data

(60) Provisional application No. 62/981,851, filed on Feb. 26, 2020.

(51) Int. Cl.
*A47K 3/38* (2006.01)
*A47H 13/02* (2006.01)

(52) U.S. Cl.
CPC ..... *A47K 3/38* (2013.01); *A47H 13/02* (2013.01)

(58) Field of Classification Search
CPC ..... A47K 3/38; A47H 13/01; A47H 13/02; A47H 13/04
See application file for complete search history.

(56) References Cited

U.S. PATENT DOCUMENTS

| | | | | |
|---|---|---|---|---|
| 6,041,454 | A | 3/2000 | Summerford | |
| 7,735,189 | B2 | 6/2010 | Richardson | |
| D664,423 | S | 7/2012 | Cittadino | |
| 8,286,304 | B2 | 10/2012 | Valade | |
| 8,381,374 | B2 | 2/2013 | Henry | |
| 9,107,544 | B2 | 8/2015 | Cittadino | |
| 10,448,774 | B1 | 10/2019 | Brown | |
| 2004/0031576 | A1* | 2/2004 | Zahner | A47H 13/02 160/330 |
| 2008/0178423 | A1* | 7/2008 | Patel | A47H 13/14 16/87.2 |
| 2009/0302182 | A1 | 12/2009 | Cittadino | |
| 2010/0065229 | A1* | 3/2010 | Hu | A47H 13/02 160/330 |
| 2010/0218905 | A1 | 9/2010 | Stern | |
| 2011/0219533 | A1 | 9/2011 | Hu | |
| 2013/0167335 | A1 | 7/2013 | Henry | |
| 2017/0208981 | A1 | 7/2017 | Nir | |
| 2017/0314607 | A1* | 11/2017 | Bauer | A47H 1/142 |
| 2018/0020861 | A1* | 1/2018 | Beyda | A47H 13/02 160/124 |

* cited by examiner

*Primary Examiner* — Janie M Loeppke
(74) *Attorney, Agent, or Firm* — Adler Pollock & Sheehan P.C.

(57) ABSTRACT

An article includes a unitary front part, a left rear part, a right rear part, the front part, the left rear part and the right rear part molded from a flexible plastic material, and a liner, the rear parts fixed to the front part with the liner sandwiched between them.

5 Claims, 9 Drawing Sheets

DOUBLE RING SHOWER LINER

CROSS REFERENCE TO RELATED APPLICATIONS

This application claims benefit from U.S. Provisional Patent Application Ser. No. 62/981,851, filed Feb. 26, 2020, which is incorporated by reference in its entirety.

BACKGROUND OF THE INVENTION

The present invention relates generally to a shower liner that can easily be installed on a shower rod.

Liners are typically hung from shower rods using hooks and other types of hanging devices. The installation procedure is relatively complex and time consuming.

SUMMARY OF THE INVENTION

The following presents a simplified summary of the innovation in order to provide a basic understanding of some aspects of the invention. This summary is not an extensive overview of the invention. It is intended to neither identify key or critical elements of the invention nor delineate the scope of the invention. Its sole purpose is to present some concepts of the invention in a simplified form as a prelude to the more detailed description that is presented later.

In general, in one aspect, the invention features an article including a unitary front part, a left rear part, a right rear part, the front part, the left rear part and the right rear part molded from a flexible plastic material, and a liner, the rear parts fixed to the front part with the liner sandwiched between them.

In another aspect, the invention features an assembly including a shower liner with a top edge, and double rings coupled to the liner proximate the top edge, wherein the double rings each include two spaced holes that are configured to accommodate a shower rod, and a slot connecting the holes to define a central arm that is free at one end.

In still another embodiment, the invention features double ring structure for coupling a shower liner to a shower rod including a front part including two spaced holes that are configured to accommodate a shower rod, a slot connecting the holes to define a central arm that is free at one end, a living hinge that bifurcates the front part, and small spaced posts projecting from a rear face of the front part, and two separate rear parts each including a hole and slot that define an arm, and small spaced post-receiving openings, wherein the posts are configured to pass through a shower liner, with the holes in the front part and rear parts located over a cutout in the shower liner.

These and other features and advantages will be apparent from a reading of the following detailed description and a review of the associated drawings. It is to be understood that both the foregoing general description and the following detailed description are explanatory only and are not restrictive of aspects as claimed.

BRIEF DESCRIPTION OF THE DRAWINGS

These and other features, aspects, and advantages of the present invention will become better understood with reference to the following description, appended claims, and accompanying drawings where:

DETAILED DESCRIPTION

Figure 1:
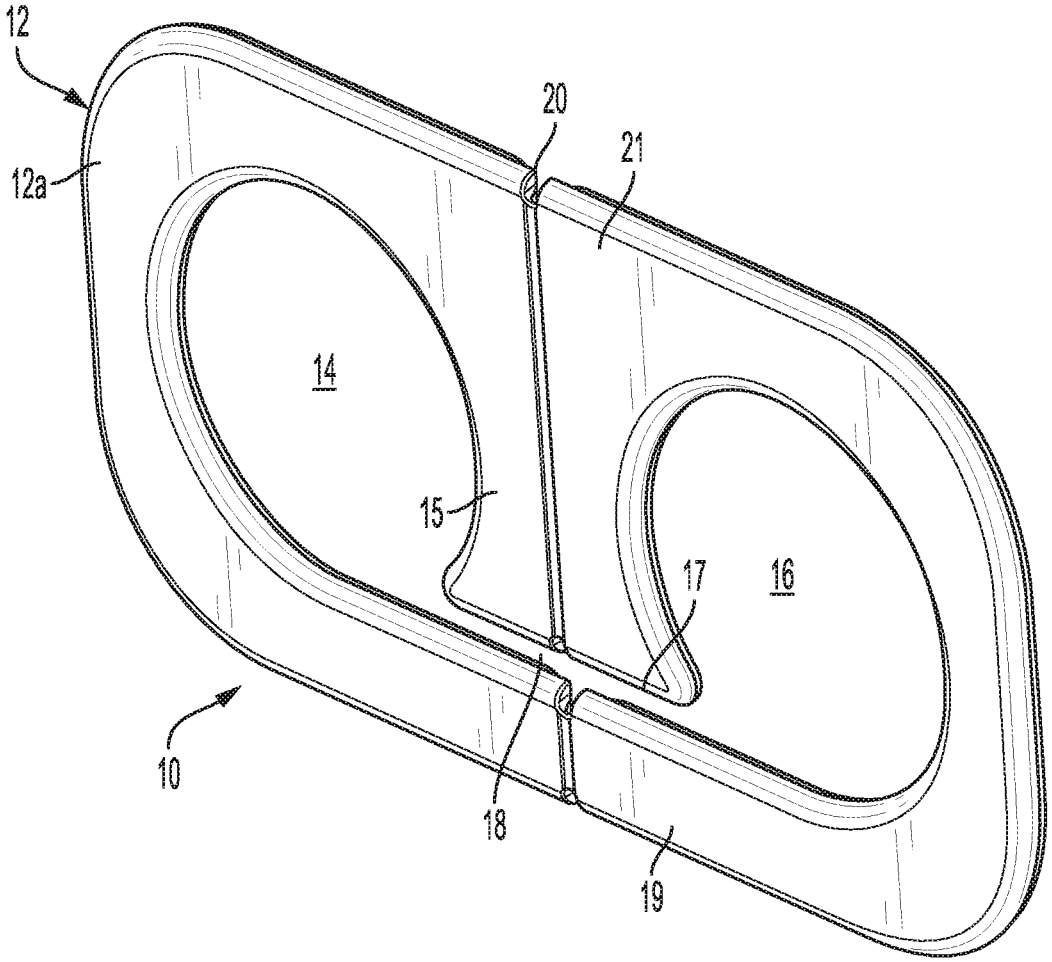
FIG. 1 is a front perspective view of a double ring used to couple a shower liner to a shower rod.

The subject innovation is now described with reference to the drawings, wherein like reference numerals are used to refer to like elements throughout. In the following description, for purposes of explanation, numerous specific details are set forth in order to provide a thorough understanding of the present invention. It may be evident, however, that the present invention may be practiced without these specific details. In other instances, well-known structures and devices are shown in block diagram form in order to facilitate describing the present invention.

A double ring shower liner of the present invention generally includes a shower liner to which is coupled double rings. The double rings are easily pushed over the shower rod in order to install the double ring shower liner on the shower rod. No hooks or other hanging hardware is involved in the installation, making the installation quick and simple.

An exemplary double ring 10 is shown in FIGS. 1, 2A, 2B, and 4. Generally, the double ring 10 includes a unitary front part 12, a left rear part 32 and a right rear part 42. The rear parts 32, 42 are fixed to the front part 12 with a shower liner (not shown) sandwiched between them. The double rings 10 are then pushed over a shower rod (not shown) in order to install the shower liner on the shower rod.

In an embodiment, the double ring 10 is a generally rectangular, thin, flat, flexible plastic structure. The three parts 12, 32, 42 can be molded or punched from a flexible plastic material so that they can function as described herein. In use, these three parts 12, 32, 42 are coupled together, back-to-back, with the shower liner sandwiched between them. In another example, the front part 12 and the two rear parts 32, 42 can be permanently coupled together but relatively movable so that the liner can be sandwiched between them.

The front part 12 has a front side 12*a* and a rear side 12*b*. Holes 14, 16 pass through a thickness of the front part part 12, from its front to its rear. A slot 18 connects the holes 14, 16 to define an arm or peninsula 15 with a distal end 17 that abuts the slot 18. The arm 15 is cantilevered from an upper portion 21 of the front part 12 so that the arm 15 can be moved or flexed in and out relative to the upper portion 21 of front part 12. Front part 12 includes a central bifurcating living hinge 20 that enables it to be folded in half along a vertical axis of the central bifurcating living hinge 20, as shown in FIG. 2B.

Figure 2A:
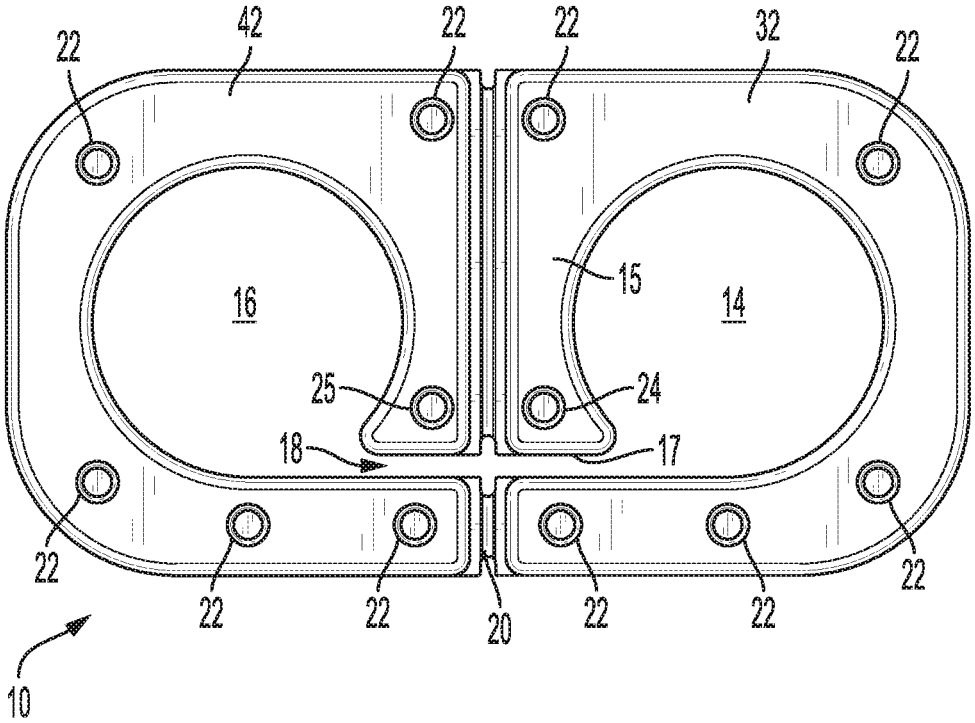
FIG. 2A is a rear view of the double ring of FIG. 1.
Figure 2B:
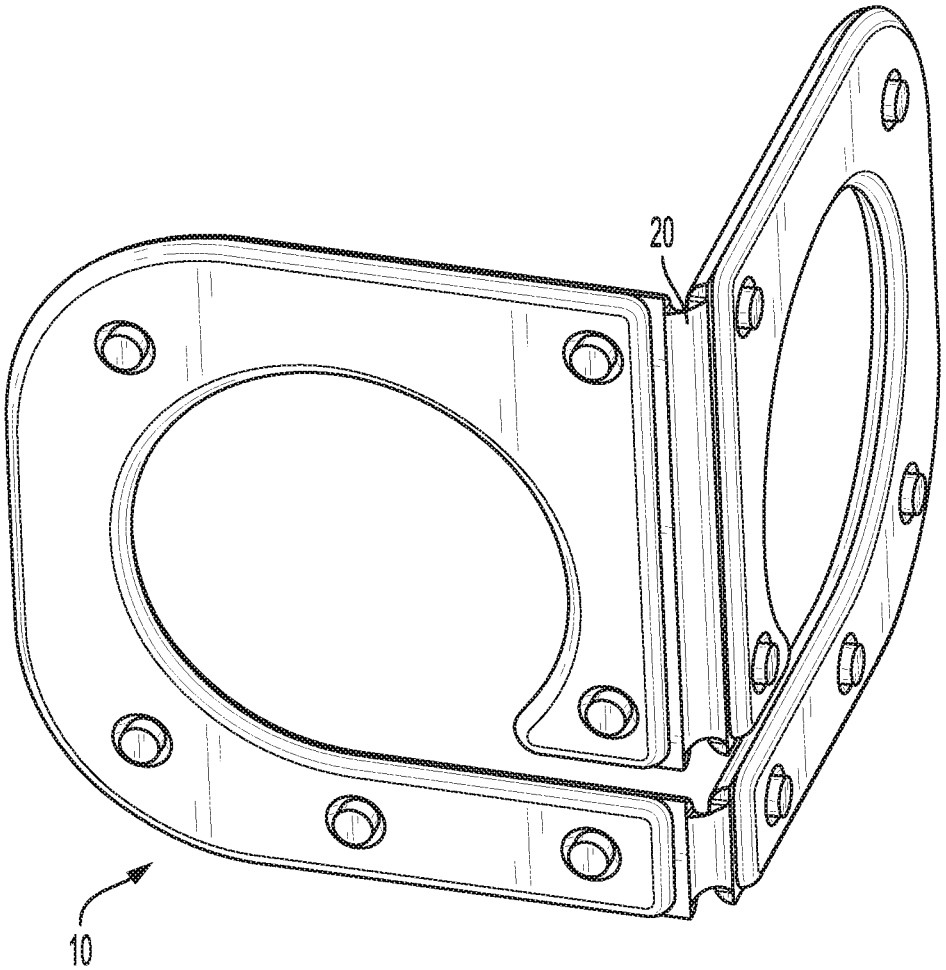
FIG. 2B is a rear view of the double ring of FIG. 1 in a bent, use position.

In the rear view of double ring 10, FIG. 2A, the left and right rear parts 32, 42 can be seen coupled to the rear side 12*b* of front part 12. The rear side 12*b* carries projecting posts or pins 22 that are configured to pass into or through the rear parts 32, 42 and be captured in the rear parts 32, 42. In this example, there are a total of ten posts 22 that are spaced along a circumference of the double ring 10, although there could be more than or less than ten and their spacing and locations may vary. The rear side 12*b* also carries posts 24, 25, which, like posts 22, are captured in the rear parts 32, 42. In an example and as explained in more detail below, once rear parts 32, 42 are assembled onto posts 22, 24, and 25, the front part 12 and the two rear parts 32, 42 are fixed together, such as by heat sealing, sonic welding, plastic deformation, adhesive bonding, mechanical fastening, or the like. In an example, the rear parts 32, 42 snap onto the posts. In another example, the rear parts 32, 42 are heat bonded together. In other examples, the rear parts 32, 42 are fixed to the front part 12 without the use of posts.

Figure 3A:
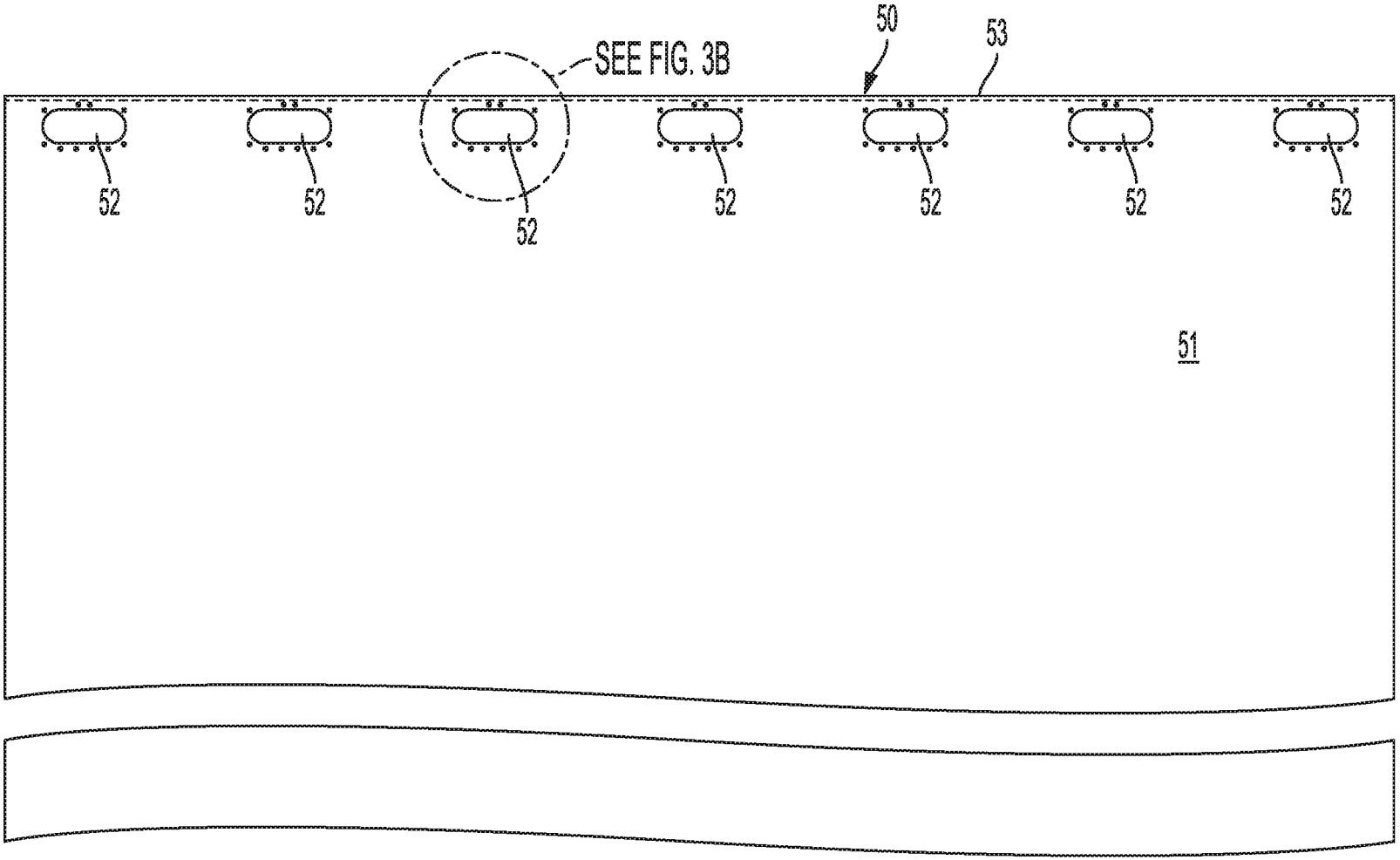
FIG. 3A illustrates a shower liner that is configured to be used with the double ring of FIG. 1.
Figure 3B:
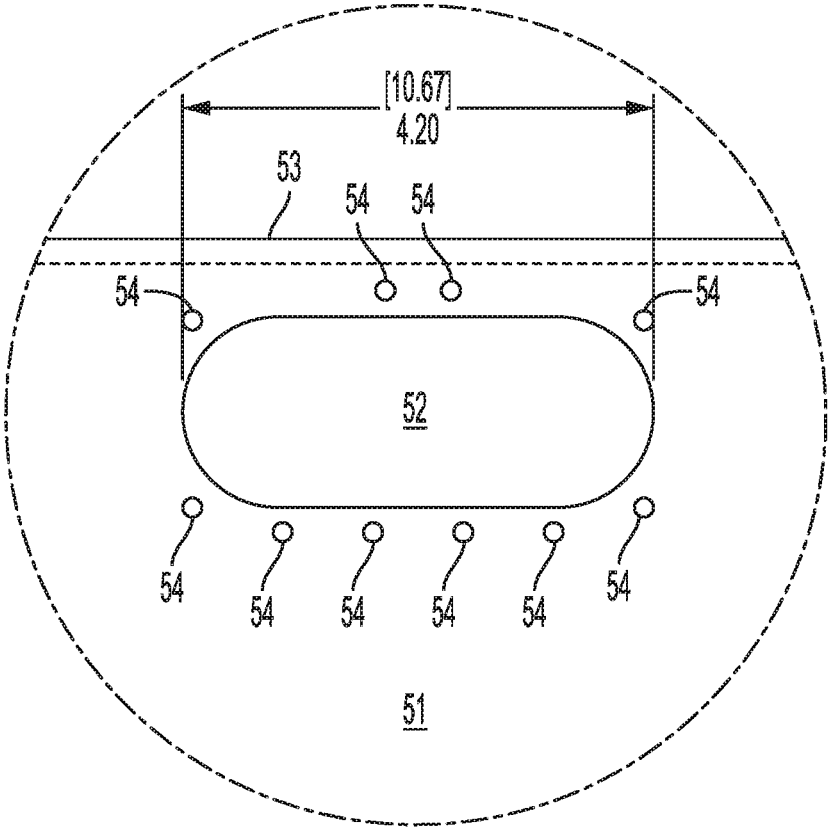
FIG. 3B is a close-up view of one cutout region of the shower liner of FIG. 3A.

An exemplary shower liner 50 that is adapted for use with double ring 10 is depicted in FIGS. 3A and 3B. A flexible sheet material 51 (such as, for example, vinyl or PVC) is formed or cut to a size that will fit in a tub/shower combination or a shower stall. Near and along a top edge 53, a number of spaced holes or cutouts 52 are formed in the flexible sheet material 51. These holes 52 can be punched in the flexible sheet material 51 or can be formed when the flexible sheet material 51 is formed.

As shown in FIG. 3B, spaced around each hole (or cutout) 52 are a number of smaller holes 54 that are located and sized to allow a post to pass there-through. More specifically, cutout 52 is sized and shaped such that there is an opening in flexible sheet material 51 behind the holes 14 and 16, the slot 18, and arm 15 of double ring 10. The cutout 52 enables the shower rod 60 (FIGS. 5A-5E) to pass through the holes 14, 16 and also enables the arm 15 to be bent back and fit over the shower rod 60.

Figure 4:
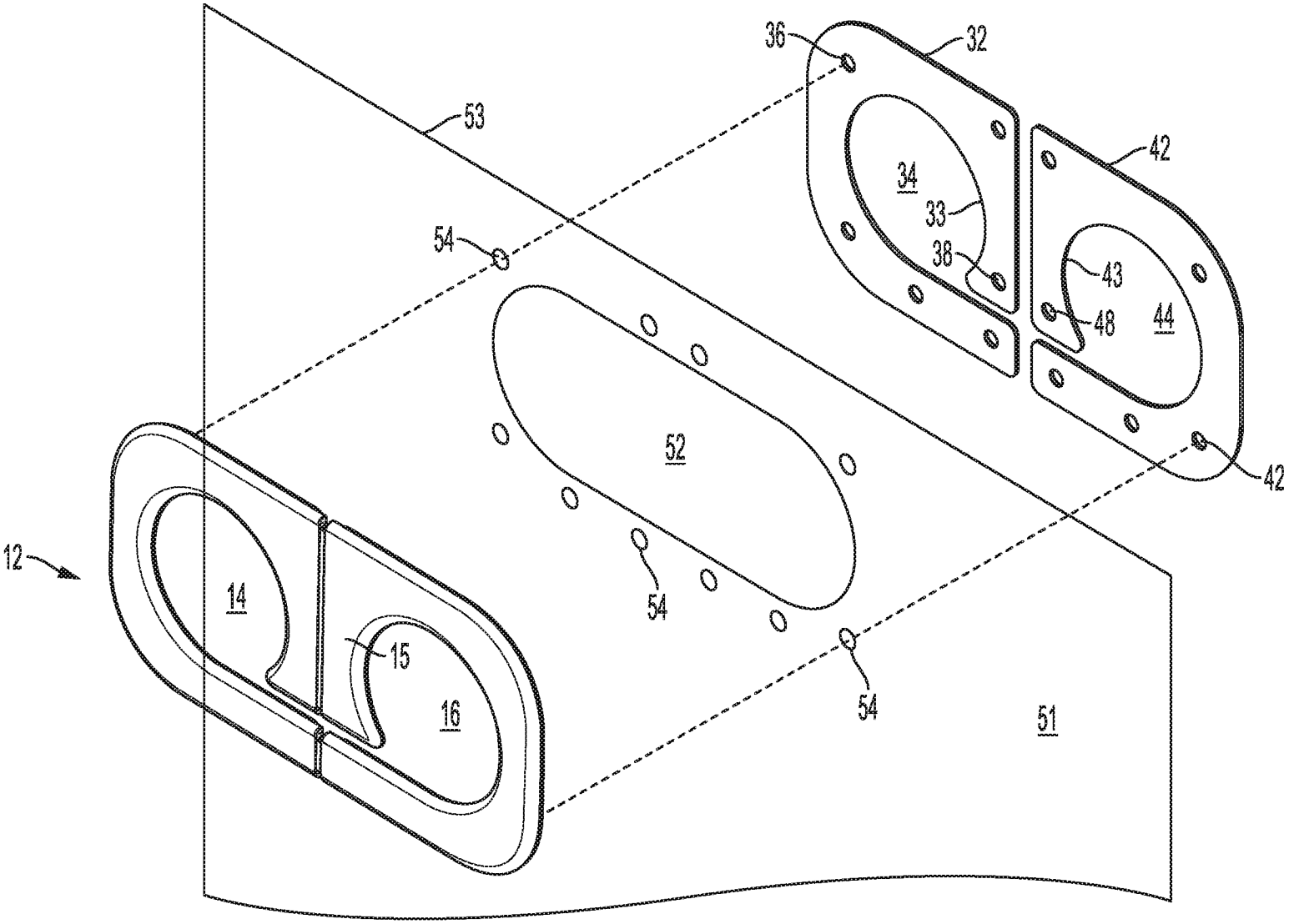
FIG. 4 is an exploded view illustrating how a double ring is coupled to the shower liner.
Figure 5A:
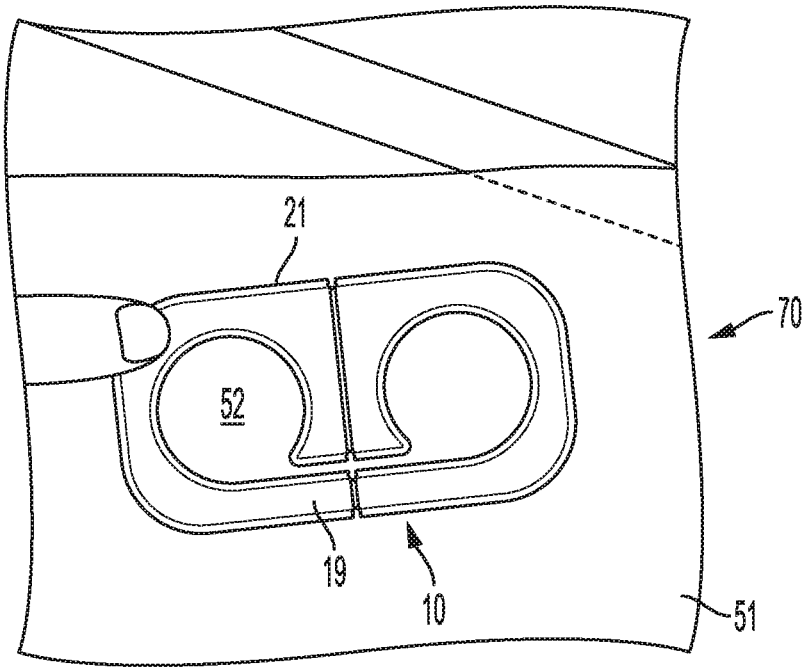
FIGS. 5A-5E illustrate steps involved in installing a double ring shower liner on a shower rod.
Figure 5B:
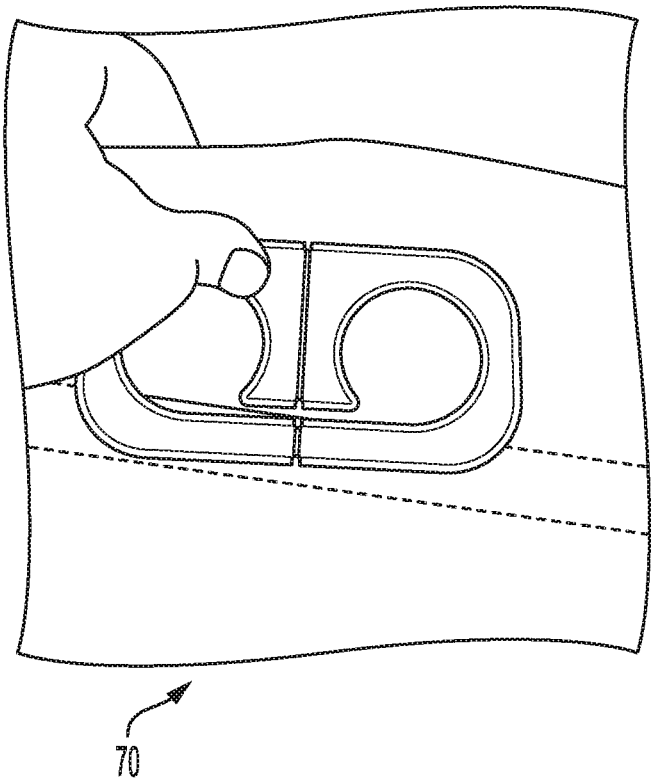
Figure 5C:
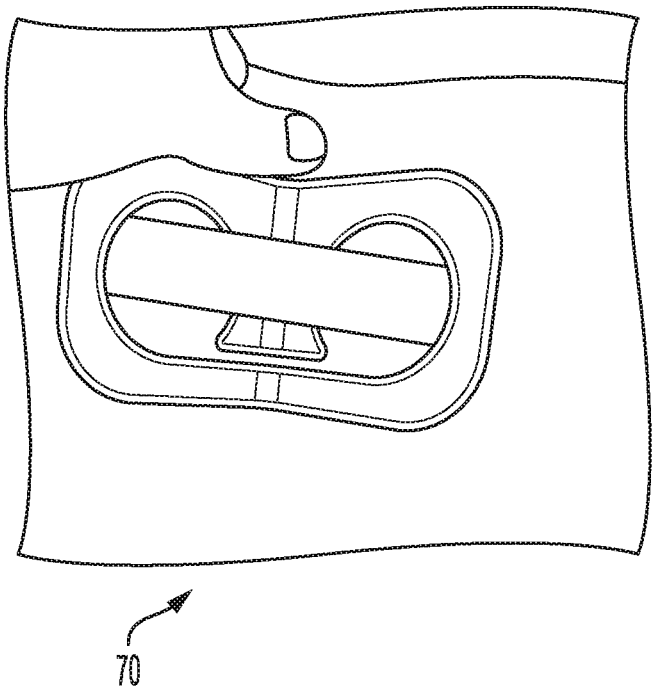
Figure 5D:
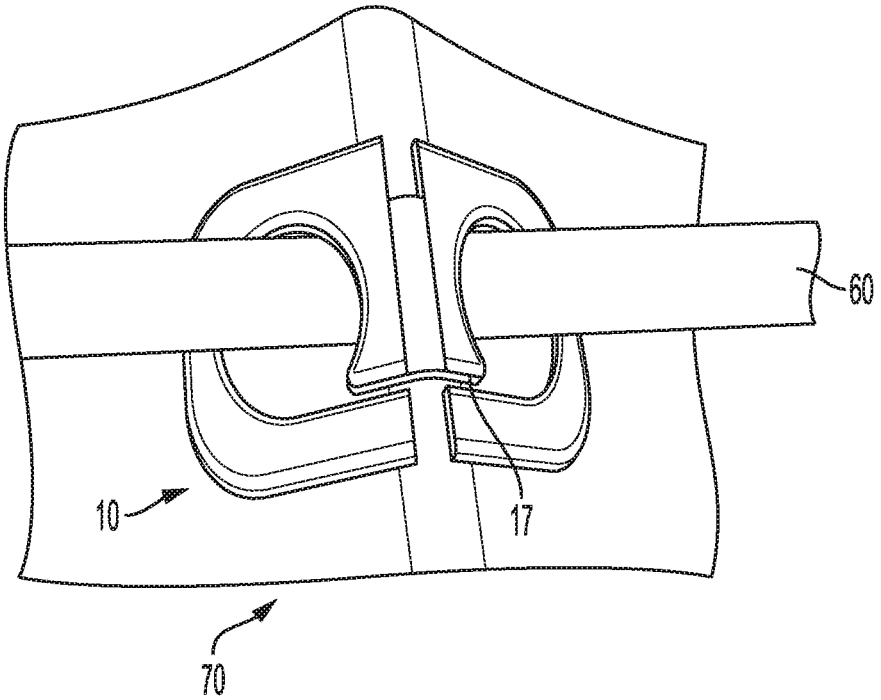
Figure 5E:
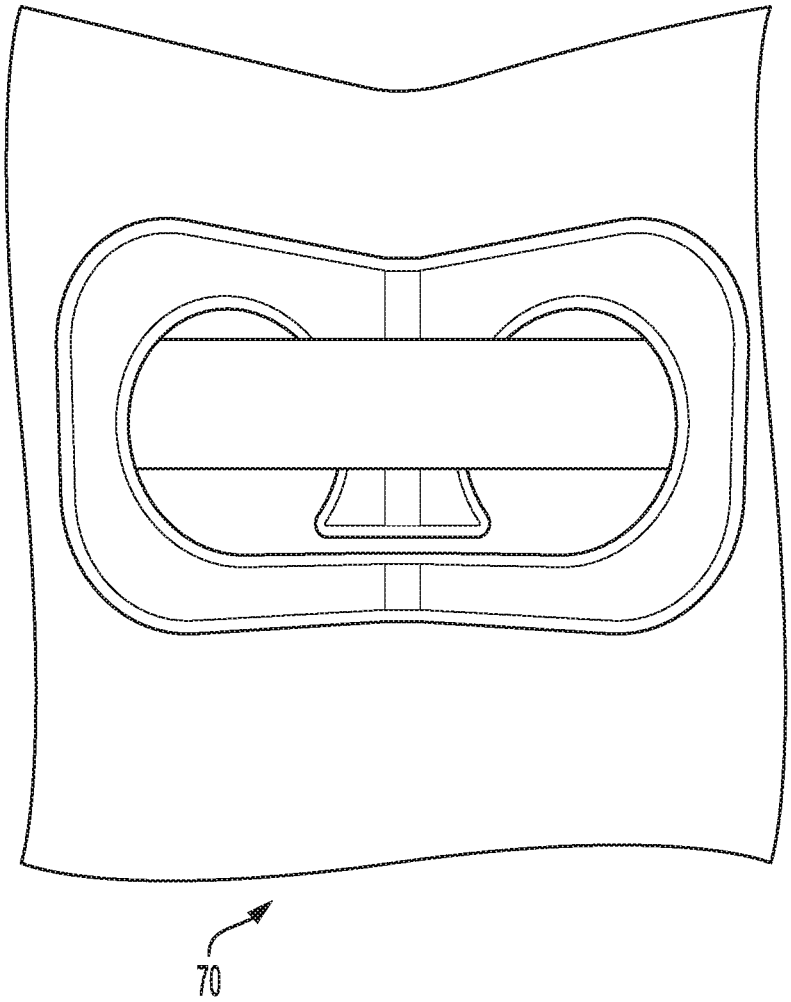

As shown in FIG. 4, the exemplary double ring 10 is assembled on both faces of the shower liner 50, at each cutout 52. The posts pass through the smaller holes 54 and through the corresponding post-receiving openings or cavities in rear parts 32 and 42. In FIG. 4, only small openings 36 and 46 are numbered. Rear parts 32, 42 are sized and shaped to cover one half of the front part 12 while not covering the central bifurcating living hinge 20. Arms 33 and 43 are located behind arm 15. Holes 34 and 44 of parts 32 and 42 are aligned with holes 14 and 16 of the front part 12. Openings 38 and 48 are located to be coupled to posts 24 and 25. Rear parts 32 and 42 are fixed to the front part 12 as described above, to create an assembly 70 (FIG. 5) including shower liner 50 carrying a number of double rings 10 along the top of the shower liner 50. Double rings 10 can then be used to couple the shower liner to the shower rod 60. In other examples (not shown) rings 10 are fixed to each other and/or the shower liner in another manner, such as with adhesive or mechanical fasteners.

Assembly 70 is coupled to shower rod 60 as follows, and as depicted in FIGS. 5A-5E. The top portion 21 of double ring 10 is held in the hand while the bottom part 19 is against rod 60 (see FIGS. 5A and 5B). Central arm 15 is then pushed over the shower rod 60 and the assembly 70 is then slid down, so that the arm 15 is behind the rod 60 (see the front view of FIG. 5C and the rear view of FIG. 5D). When the double ring 10 is pushed all the way down it flexes back into shape, with rod 60 located in holes 14 and 16 (see FIG. 5E).

Assembly 70 can be provided to the user in a fully-assembled state (as shown in FIGS. 5A-5E), or the shower liner with holes can be sold separately from the double rings and the double rings can be coupled to the shower liner by the user. In the latter case, the front and rear parts of double ring 10 would be designed to be snapped together by the user or coupled or fixed together in another manner. In an example, the design can be such that the posts form an interference fit with the corresponding openings of the rear parts. In another example, the front part and the rear parts of the double ring are permanently fixed together by a living hinge that runs along the tops of the parts to create a clam shell arrangement so that the parts can be separated in order to accept the shower liner, and then coupled together around the shower liner.

It would be appreciated by those skilled in the art that various changes and modifications can be made to the illustrated embodiments without departing from the spirit of the present invention. All such modifications and changes are intended to be within the scope of the present invention except as limited by the scope of the appended claims.

What is claimed is:

1. An article comprising:

a unitary front part;

a left rear part;

a right rear part, the front part, the left rear part and the right rear part molded from a flexible plastic material;

a liner, the rear parts fixed to the front part with the liner sandwiched between them, wherein the front part comprises a front side and a rear side;

holes that pass through a thickness of the front part from its front to its rear, wherein a slot connects the holes to define an arm with a distal end that abuts the slot, wherein the arm is cantilevered from an upper portion of the front part so that the arm can be moved or flexed in and out relative to the upper portion of front part, and wherein the front part further comprises a central bifurcating living hinge that enables it to be folded in half along a vertical axis of the central bifurcating living hinge.

2. The article of claim 1 wherein the rear side further carries projecting posts configured to pass into or through and be captured by the rear parts.

3. The article of claim 2 wherein the rear side further carries posts which are captured in the rear parts.

4. An assembly comprising:

a shower liner with a top edge; and a plurality of double rings coupled to the liner proximate the top edge, wherein the double rings each comprise two spaced holes that are configured to accommodate a shower rod, and a slot connecting the holes to define a central arm that is free at one end, wherein the double rings further comprise a living hinge, wherein the living hinge bifurcates the central arm.

5. A double ring structure for coupling a shower liner to a shower rod, comprising:

a front part comprising two spaced holes that are configured to accommodate a shower rod, a slot connecting the holes to define a central arm that is free at one end, a living hinge that bifurcates the front part, and a plurality of small spaced posts projecting from a rear face of the front part; and two separate rear parts each comprising a hole and slot that define an arm, and a plurality of small spaced post-receiving openings;

wherein the posts are configured to pass through a shower liner, with the holes in the front part and rear parts located over a cutout in the shower liner.

* * * * *